United States Patent [19]

Ohashi et al.

[11] Patent Number: 5,034,146

[45] Date of Patent: Jul. 23, 1991

[54] RARE EARTH-BASED PERMANENT MAGNET

[75] Inventors: Ken Ohashi; Yoshio Tawara, both of Fukui, Japan

[73] Assignee: Shin-Etsu Chemical Co., Ltd., Tokyo, Japan

[21] Appl. No.: 554,073

[22] Filed: Jul. 16, 1990

Related U.S. Application Data

[62] Division of Ser. No. 60,530, Jun. 11, 1987, abandoned.

[30] Foreign Application Priority Data

Jun. 26, 1986 [JP] Japan ..... 61-149979

[51] Int. Cl.[5] ..... C2C 28/00; H01F 1/08

[52] U.S. Cl. ..... 252/62.57; 252/62.58; 75/244; 75/347; 148/101; 148/302; 420/83; 420/416; 420/440

[58] Field of Search ..... 252/62.57, 62.58; 75/0.5 BB, 244; 148/101, 302; 420/83, 416, 440

[56] References Cited

U.S. PATENT DOCUMENTS 4,681,623 7/1987 Okajima ..... 75/0.5 BB X 4,684,406 8/1987 Matsuura ..... 148/302

FOREIGN PATENT DOCUMENTS 0177371 4/1986 European Pat. Off. .

0177346 10/1984 Japan ..... 148/302

0077943 5/1985 Japan ..... 148/302

*Primary Examiner*—Jacqueline V. Howard

*Attorney, Agent, or Firm*—Hopgood, Calimafde, Kalil, Blaustein & Judlowe

[57] ABSTRACT

The magnetic properties or, in particular, coercive force of a sintered permanent magnet composed of a light rare earth element, boron and iron can be greatly improved without affecting the residual magnetic flux by the admixture of a relatively small amount of additive elements including heavy rare earth elements, aluminum, titanium, vanadium, niobium and molybdenum. In the inventive magnets, the distribution of the additive element is not uniform but localized in the vicinity of the grain boundaries of the matrix particles. Such a localized distribution of the additive elements is obtain by sintering a powder mixture composed of a powder of an alloy of the base ingredients and a powder containing the additive element or elements.

4 Claims, No Drawings

RARE EARTH-BASED PERMANENT MAGNET

This application is a division, of application Ser. No. 060530, filed June 11, 1987 now abandoned.

BACKGROUND OF THE INVENTION

The present invention relates to a rare earth-based permanent magnet or, more particularly, to a permanent magnet which is a sintered body of a rare earth-based alloy having excellent magnetic properties prepared by a powder metallurgical process and useful as a component of various kinds of electric and electronic instruments as well as a method for the preparation of the rare earth-based permanent magnet.

Among the various types of rare earth-based permanent magnets hitherto developed and currently used in many applications, a recently highlighted class of the magnets includes those having an alloy composition of neodymium, iron and boron as the essential alloying elements. These neodymium-iron-boron magnets have very excellent magnetic properties equivalent to or even better than the previously developed samarium-cobalt magnets and are still advantageous in respect of the abundance of the neodymium resources in comparison with samarium contained in rare earth minerals only in a relatively minor content as well as the inexpensiveness of iron in comparison with cobalt (see, for example, Japanese Patent Kokai 59-46008).

Despite the generally excellent magnetic properties, the neodymium-iron-boron magnets are not free from a problem because the Curie point $T_c$ of the magnets is relatively low, for example, at 312° C. or below for the phase of an intermetallic compound of $Nd_2Fe_{14}B$. Consequently, the temperature dependency of the magnetic properties is large to cause limitations in the use of these permanent magnets at elevated temperatures. In particular, the coercive force ${}_iH_c$ greatly decreases by the increase in temperature to such an extent that the magnets cannot be used as such in many applications. An attempt has been made in this regard to increase the coercive force of the magnet at room temperature by the admixture of a certain additive to the neodymium-iron-boron alloy to such an extent that the coercive force even after decrease by a possible temperature increase during use may still be high enough not to lose the practical usefulness of the magnet. The hitherto proposed additives for such a purpose include, for example, so-called heavy rare earth elements such as dysprosium, terbium, holmium and the like, transition metals such as titanium, vanadium, niobium, molybdenum and the like and aluminum (see Japanese Patent Kokai 59-898401 and 60-32306).

Although these additive elements indeed have an effect to increase the coercive force of the neodymium-iron-boron magnets, the residual magnetic flux $B_r$ of the magnets is necessarily decreased by the addition of these additives. Therefore, it is an important problem that the coercive force of the magnet can be sufficiently increased with a minimum decrease in the residual magnetic flux by appropriately selecting the kinds and combination of the additive elements. In particular, the heavy rare earth elements have a larger effect of increasing the coercive force than the other additive elements but at a sacrifice of a large decrease in the residual magnetic flux as a consequence of the anti-parallel alignment of the magnetic moments in the heavy rare earth element and iron. In addition, these heavy rare earth elements are contained in the rare earth minerals only in very low contents so that they are necessarily very expensive and the amount of addition of these heavy rare earth elements in the magnet alloys should be as small as possible also for the economical reason.

SUMMARY OF THE INVENTION

An object of the present invention is therefore to provide a rare earth-based permanent magnet having extremely high magnetic properties overcoming the above described problems and disadvantages in the conventional neodymium-iron-boron magnets by using only a relatively small amount of the expensive heavy rare earth elements.

Another object of the invention is to provide a method for the preparation of the above described novel rare earth-based permanent magnet.

Thus, the rare earth-based permanent magnet provided by the present invention is a magnetically anisotropic sintered body of permanent magnet essentially composed of:

(a) from 20 to 35% by weight of one or a combination of light rare earth elements, denoted by the symbol R hereinbelow, selected from the group consisting of lanthanum, cerium, praseodymium, neodymium, samarium and europium;

(b) from 0.5 to 1.5% by weight of boron;

(c) from 0.1 to 10% by weight of one or a combination of the elements, denoted by the symbol L hereinbelow, selected from the group consisting of heavy rare earth elements including gadolinium, terbium, dysprosium, holmium, erbium, thulium, ytterbium, lutetium and yttrium, aluminum, titanium, vanadium, niobium and molybdenum; and (d) the balance of iron or a combination of iron and cobalt, denoted by the symbol M hereinbelow, the distribution of the element or elements denoted by L being non-uniform within the matrix particles of the composition expressed by the formula $R_2M_{14}B$.

The above described rare earth-based permanent magnet can be prepared in a powder metallurgical process in which the elements forming the matrix phase and the additive elements are separately alloyed and the two alloys are mixed together either by the simultaneous pulverization or after separate pulverization followed by molding and sintering of the powder mixture into a sintered body.

DETAILED DESCRIPTION OF THE PREFERRED EMBODIMENTS

As is described in the above given summary of the invention, the most characteristic feature of the inventive rare earth-based permanent magnet is the non-uniform distribution of the additive elements denoted by the symbol L within the matrix particles of the composition $R_2M_{14}B$. The procedure of the investigations leading to the establishment of such a unique structure of the permanent magnet is as follows.

As is taught in Journal of Applied Physics, volume 55, page 2083 (1984), it is generally accepted mechanism that the coercive force of the neodymium-based permanent magnets is produced by the nucleation-growth mechanism and it is recently discussed in Japanese Journal of Applied Physics, volume 24, page L30 (1985) on the base of the results of electron microscopic examination that the large coercive force of the $Nd_2Fe_{14}B$ magnets may be a consequence of the magnetic domain walls pinned up to the thin and soft b.c.c. phase enveloping the surface of the crystalline grains. In the conventional methods for the preparation of the neodymium-based permanent magnets with the additive elements of heavy rare earth elements, aluminum, vanadium and the like to enhance the coercive force, the magnet alloy is prepared usually by melting these additive elements together with the other principal elements so that the distribution of the additive elements is uniform throughout the matrix phase of the 2:14:1 compound while the additive elements have an effect of increasing the anisotropic magnetic field of the 2:14:1 compound or influencing the morphology in the vicinity of the crystalline grain boundaries. Based on the above described facts and discussions, the inventors have arrived at an idea that increase in the coercive force of the magnet would be obtained merely by controlling the vicinity of the crystalline grain boundaries alone and continued extensive investigations to realize such a principle of grain boundary control. Namely, the scope of the present invention is to effect the grain boundary control by forming a structure in which the additive elements having the effect of increasing the coercive force are contained in a localized distribution only at the vicinity of the grain boundaries responsible for the coercive force of the magnet.

The above described localized distribution of the additive elements can be obtained by the powder metallurgical process, which in itself may be conventional including compression molding of a powder and sintering of the green body, of a powdery mixture composed of a first alloy of the principal elements and a second alloy of the additive elements separately melted to form the respective alloys followed by simultaneous pulverization. It is of course optional that the powder of the additive element or elements may be prepared separately beforehand. For example, a single kind of a powder of aluminum or niobium may be used as the additive powder. Further, an oxide powder of the heavy rare earth element such as dysprosium oxide $Dy_2O_3$ and terbium oxide $Tb_4O_7$ may be used in place of the metal or alloy. An intermetallic binary compound such as Dy-Al and Tb-Fe can be used. When the powdery mixture of the principal matrix phase and the additive elements is subjected to sintering, the additive elements may diffuse into the matrix particles of $R_2M_{14}B$ from the surface but never reach the core portion of the particles so that the additive elements are contained in the resultant structure in a localized distribution at or in the vicinity of the grain boundaries.

As is described before, the chemical composition of the inventive permanent magnet is essentially composed of from 20 to 35% by weight of the element or elements denoted by R, from 0.5 to 1.5% by weight of boron, from 0.1 to 10% by weight of the element or elements denoted by L and the balance of the element or elements denoted by M. This weight proportion of the elements is critical. When the content of the element or elements denoted by R is smaller than 20% by weight, the permanent magnet would have no sufficiently high coercive force while the oxidation resistance of the permanent magnet would be decreased by increasing the amount over 35% by weight. When the amount of boron is smaller than 0.5% by weight, the coercive force of the permanent magnet is also decreased while increase of the amount of boron over 1.5% by weight is undesirable due to a relatively large decrease in the residual magnetic flux of the magnet. When the amount of the additive element or elements denoted by L is smaller than 0.1% by weight, it is of course that the desired effect of increasing the coercive force of the magnet cannot be exhibited while increase of the amount thereof over 10% by weight also causes a large decrease in the residual magnetic flux. The component denoted by M is iron or a combination of iron and cobalt. Substitution of cobalt for a part of iron has an effect to increase the Curie point correspondingly contributing to the improvement in the reversible temperature dependency of the magnetic properties although it may be too much to say that the use of cobalt in place of iron results in increase in the material cost.

The light rare earth element denoted by R is selected from the group consisting of lanthanum, cerium, praseodymium, neodymium, samarium and europium, of which neodymium is preferred in view of the balance between the magnetic properties of the permanent magnet and the cost although any of these light rare earth elements can be used either singly or as a combination of two kinds or more. When the additive element denoted by L is a heavy rare earth element, it is selected from the group consisting of gadolinium, terbium, dysprosium, holmium, erbium, thulium, ytterbium, lutetium and yttrium, of which terbium and dysprosium are preferred. These heavy rare earth elements as well as the other additive elements including aluminum, titanium, vanadium, niobium and molybdenum can be used either singly or as a combination of two kinds or more according to need.

As is understood from the above given description, the rare earth-based permanent magnet of the invention has substantially improved coercive force and residual magnetic flux over conventional neodymium-boron-iron magnets without increasing the amount of expensive additive elements such as heavy rare earth elements consequently without increasing the production costs. Accordingly, the rare earth-based permanent magnets of the invention are very promising as a component in various kinds of high-performance electric and electronic instruments.

In the following, the rare earth-based permanent magnet of the invention and the method for the preparation of the same are described in more detail by way of examples and comparative examples.

EXAMPLE 1 AND COMPARATIVE EXAMPLE 1.

In Example 1, metals of neodymium and iron each having a purity of 99.9% and metallic boron having a purity of 99.5% were taken in amounts respectively corresponding to a chemical formula of $Nd_{15}Fe_{78}B_7$(32.8% Nd, 66.0% Fe and 1.2% B, each by weight) and they were melted together in a high-frequency induction furnace under an atmosphere of argon followed by casting of the melt to give an ingot of a first alloy. Separately, an ingot of a second alloy corresponding to a chemical formula of $DyFe_2$(59.3% Dy and 40.7% Fe, each by weight) was prepared in a similar manner to the above from metals of dysprosium and iron each having a purity of 99.9%. These two kinds of alloys were each crushed into coarse granules and taken and mixed in a weight proportion of 98:2 of the first to the second alloys. The mixture of granules was finely pulverized in a ball mill for 5 hours in a medium of n-hexane. The thus obtained fine pow-der of the alloys had an average particle diameter of 3.5 $\mu$m.

The alloy powder was compression-molded in a magnetic field of 15 kOe under a compressive force of 1 ton/cm$^2$ into a green body which was subjected to sintering by heating in a furnace filled with argon gas to replace air first at 1050° C. for 1 hour followed by quenching down to a temperature of 550° C. where the sintered body was aged for 1 hour.

For comparison, a third alloy was prepared in Comparative Example 1 by melting together neodymium, dysprosium, iron and boron each in a metallic form having a purity mentioned above in such a proportion that the weight ratio of these four elements was just the same as in the 98:2 blend of the first and second alloys mentioned above. This third alloy was processed into a sintered anisotropic permanent magnet in the same manner as above.

Examination of a cross section of the inventive permanent magnet in Example 1 was undertaken by using an electron microprobe analyzer. The line profiles for the distribution of neodymium and dysprosium indicated localized distribution of dysprosium in the vicinity of the grains corresponding to the matrix phase of $Nd_2Fe_{14}B$ and substantial absence of dysprosium in the core portion of the grains. On the contrary, the same electron microprobe analysis of the comparative permanent magnet in Comparative Example 1 indicated that the distribution of dysprosium was relatively uniform throughout the matrix of the $Nd_2Fe_{14}B$ grains.

Further, the magnetic properties of these permanent magnets were measured to give the results shown in the table given below. It was understood from the results shown in this table as combined with the information obtained by the electron microprobe analysis that the distribution of the additive element in and around the matrix grains had profound influences on the magnetic properties or, in particular, coercive force and residual magnetic flux of the sintered permanent magnets.

EXAMPLE 2 AND COMPARATIVE EXAMPLE 2.

The experimental procedure in Example 2 was substantially the same as in Example 1 except that the first and second alloys taken in a weight proportion of 98:2 had chemical compositions of the formulas $Pr_{15}Fe_{79}B_6$(32.1% Pr, 66.9% Fe and 1.0% B, each by weight) and $Al_6Mo$ (62.8% Al and 37.2% Mo, each by weight), respectively, and sintering of the green body was performed first at 1070° C. for 1 hour and then at 950° C. for 1 hour followed by aging at 600° C. for 1 hour.

In Comparative Example 2 undertaken for comparative purpose, the same procedure of sintering and aging was performed by using a green body prepared from a powder of an alloy composed of praseodymium (Pr), iron (Fe), boron (B), aluminum (Al) and molybdenum (Mo) melted together in the same weight proportion as in the powdery blend of the first and second alloys in Example 2.

The magnetic properties of these two permanent magnets are shown in the table below.

EXAMPLE 3 AND COMPARATIVE EXAMPLE 3.

In Example 3, an alloy ingot was prepared in the same manner as in Example 1 by melting together metals of neodymium, iron and cobalt each having a purity of 99.9% and metallic boron having a purity of 99.5% in such a weight proportion that the resultant alloy corresponded to a chemical formula of $Nd_{15}(Fe_{0.80}Co_{0.20})_{78}B_7$(32.0% Nd, 51.2% Fe, 15.7% Co and 1.1% B, each by weight). The alloy ingot was coarsely crushed into granules which were admixed with 0.5% by weight of a fine powder of aluminum metal and 3.0% by weight of powdery terbium oxide of the formula $Tb_4O_7$ and the mixture was pulverized in a jet mill into a fine powder having an average particle diameter of about 3 μm. The powder was molded into a greeen body and subjected to sintering in the same manner as in Example 1 to give a sintered permanent magnet except that the temperature of sintering was 1070° C. and the step of aging was performed at a temperature of 600° C. for 2 hours.

For comparison, another alloy was prepared in Comparative Example 3 by melting together each the same material of neodymium, iron, cobalt, boron, aluminum and terbium oxide as used in Example 3 in such a proportion that the weight ratio of these six elements of neodymium, iron, cobalt, boron, aluminum and terbium was just the same as in the powdery mixture of the alloy admix-ed with the aluminum powder and terbium oxide in Example 3. The alloy was processed into a sintered anisotropic permanent magnet in the same manner as in Example 2.

The magnetic properties of these two permanent magnets were measured to give the results shown in the table below, from which it was clear that a remarkable improvement was obtained according to the invention in the coercive force of the magnet.

TABLE

| | Coercive, force, kOe | Coercive, force, kOe | Maximum energy product, MGOe |
|---|---|---|---|
| Example 1 | 12.3 | 18.6 | 36.0 |
| Comparative Example 1 | 11.9 | 14.5 | 33.5 |
| Example 2 | 12.0 | 14.0 | 34.8 |
| Comparative Example 2 | 11.3 | 9.5 | 30.2 |
| Example 3 | 11.9 | 24.5 | 33.9 |
| Comparative Example 3 | 11.7 | 17.0 | 32.5 |

What is claimed is:

1. A method for the preparation of a rare earth-based permanent magnet which is a magnetically anisotropic sintered body which comprises:
   (a) from 20 to 35% by weight of at least one kind of the light rare earth elements selected from the group consisting of lanthanum, cerium, praseodymium, neodymium, samarium and europium;
   (b) from 0.5 to 1.5% by weight of boron; rare earth elements, aluminium, titanium, vanadium, niobium and molybdenum; and
   (d) the balance of iron or a combination of iron and cobalt, which method comprises the steps of:
      (A) melting together each a weighed amount of the light rare earth element or elements, boron and iron or a combination of iron and cobalt to form an alloy;
      (B) pulverizing the alloy to give an alloy powder;
      (C) pulverizing one kind of the additive element optionally alloyed with iron or an alloy of two kinds or more of the additive elements to give an additive powder;
      (D) blending the alloy powder and the additive powder to give a powder blend;
      (E) compression-molding the powder blend in a magnetic field to give a shaped green body; and
      (F) sintering the shaped green body by heating in vacuum or in an atmosphere of an inert gas.

2. The method for the preparation of a rare earth-based permanent magnet as claimed in claim 1 wherein the heavy rare earth element is selected from the group consisting of gadolinium, terbium, dysprosium, holmium, erbium, thulium, yterbium, letetium and yttrium.

3. The method for the preparation of a rare earth-based permanent magnet as claimed in claim 1 wherein the heavy rare earth element is selected from the group consisting of gadolinium, terbium, dysprosium, holmium, erbium, thulium, ytterbium, lutetium and yttrium.

4. A method for the preparation of a rare earth-based permanent magnet which is a magnetically anisotropic sintered body which comprises:

(a) from 20 to 35% by weight of at least one kind of the light rare earth elements selected from the group consisting of lanthanum, cerium, praseodymium, neodymium, samarium and europium;

(b) from 0.1 to 1.5% by weight of boron;

(c) from 0.1 to 10% by weight of at least one kind of the additives selected from the group consisting of heavy rare earth elements, aluminum, titanium, vanadium, niobium, molybdenum and oxides of heavy rare earth elements; and (d) the balance of iron or a combination of iron and cobalt, which method comprises the steps of:

(A) melting together each a weighed amount of the light rare earth element or elements, boron and iron or a combination of iron and cobalt to form an alloy;

(B) pulverizing the alloy to give an alloy powder;

(C) admixing the alloy powder with the additive in a powdery form to give a powder blend;

(D) compression-molding the powder blend in a magnetic field to give a shaped green body; and (E) sintering the shaped green body by heating in vacuum or in an atmosphere of an inert gas.

* * * * *